US012709894B2

(12) United States Patent
Fulton

(10) Patent No.: US 12,709,894 B2
(45) Date of Patent: Aug. 18, 2026

(54) ARCHITECTURAL STRUCTURE COMPRISING PIVOTING SUSPENDED TILES

(71) Applicant: Lang and Fulton Limited, Edinburgh (GB)

(72) Inventor: Robin Fulton, Edinburgh (GB)

(73) Assignee: LANG AND FULTON LIMITED, Edinburgh (GB)

( * ) Notice: Subject to any disclaimer, the term of this patent is extended or adjusted under 35 U.S.C. 154(b) by 265 days.

(21) Appl. No.: 18/553,465

(22) PCT Filed: Mar. 31, 2022

(86) PCT No.: PCT/GB2022/050827
§ 371 (c)(1),
(2) Date: Sep. 29, 2023

(87) PCT Pub. No.: WO2022/208109
PCT Pub. Date: Oct. 6, 2022

(65) Prior Publication Data

US 2024/0183151 A1 Jun. 6, 2024

(30) Foreign Application Priority Data

Mar. 31, 2021 (GB) ..... 2104672

(51) Int. Cl.
*E04B 2/88* (2006.01)
*E04B 1/343* (2006.01)

(52) U.S. Cl.
CPC ..... *E04B 2/88* (2013.01); *E04B 1/343* (2013.01)

(58) Field of Classification Search
CPC ..... E04B 1/343; E04F 10/10; E04F 13/083; E04F 13/0862
See application file for complete search history.

(56) References Cited

U.S. PATENT DOCUMENTS 2,068,148 A * 1/1937 Moir ..... E04F 10/10 49/90.1
2,404,178 A * 7/1946 Johnson ..... E04F 10/10 206/326

(Continued)

FOREIGN PATENT DOCUMENTS

CN 202936914 U 5/2013
CN 207553390 U 6/2018

(Continued)

OTHER PUBLICATIONS

EXTech/Exterior Technologies Inc2, Dec. 4, 2015, Logan Airport Kinetic Wall, Retrieved from the Internet, youtube.com, <URL:<https://www.youtube.com/watch?v=8DXd372Qego>>.

(Continued)

*Primary Examiner* — Patrick J Maestri
(74) *Attorney, Agent, or Firm* — FOX ROTHSCHILD LLP

(57) ABSTRACT

An architectural structure comprises a grating panel (1), wherein said grating panel comprises securing means for securing said grating panel to a building or other structure, which when installed comprises substantially horizontal bars (8) and tiles (3) suspended from and pivotable on the axes of said horizontal bars, wherein said tiles cannot assume a position of stable equilibrium other than the position in which the tiles are suspended freely from said bars. The tiles may be part of tile assemblies, such that said tile assemblies comprise tile portions and locating portions which secure the tiles to the gratings.

18 Claims, 20 Drawing Sheets

(56) References Cited

U.S. PATENT DOCUMENTS

| | | | | |
|---|---|---|---|---|
| 2,952,049 | A * | 9/1960 | Vetere | E04F 10/10 D25/57 |
| 2,953,825 | A * | 9/1960 | Wells | E04F 10/10 49/402 |
| 2015/0191914 | A1* | 7/2015 | Biterman | E04F 13/0871 52/745.1 |

FOREIGN PATENT DOCUMENTS

| | | | |
|---|---|---|---|
| CN | 207582747 | U | 7/2018 |
| CN | 210105075 | U | 2/2020 |
| CN | 111227016 | A | 6/2020 |
| CN | 210685097 | U | 6/2020 |
| CN | 111561083 | A | 8/2020 |
| CN | 211278361 | U | 8/2020 |
| CN | 211817235 | U | 10/2020 |
| CN | 212388812 | U | 1/2021 |

OTHER PUBLICATIONS

EXTech, KineticWall, Retrieved from the Internet, sketchfab.com, <URL: <https://sketchfab.com/3d-models/kineticwall-53341c1379594e83abeb5deafdf7afb6>. Page archived on Nov. 15, 2019, https://web.archive.org/web/20191115210216/https://sketchfab.com/3d-models/kineticwall-53341c1379594e83abeb5deafdf7afb6 <https://web.archive.org/web/20191115210216/https:/sketchfab.com/3d-models/kineticwall-53341c1379594e83abeb5deafdf7afb6>>.

Combined Search and Examination Report under Sections 17 and 18(3) dated Jul. 26, 2021 issued in Application No. GB2104672.7 (8 pages).

International Search Report and Written Opinion of the International Searching Authority dated Jul. 20, 2022 issued in International Application No. PCT/G B2022/050827 (14 pages).

Office Action issued on Mar. 23, 2026 for Chinese Patent Application No. 2022800357401 (15 pages).

* cited by examiner

ARCHITECTURAL STRUCTURE COMPRISING PIVOTING SUSPENDED TILES

The present invention relates to architectural structures comprising gratings with suspended tiles.

Such structures have been used to clad buildings such as multi-storey car parks and large commercial buildings. They can be used on other buildings including residential properties and hotels. They can also act as barriers and can delineate boundaries, and can be mounted on other structures.

They provide a pleasing decorative effect, and in some cases are used solely for aesthetic reasons. However, they can also provide other functions including solar shading, solar control, wind reduction, privacy and ventilation effects. They can be reflective and/or their surface can be tailored to bring about particular effects, and they can provide a surface on to which images may be projected. Other possible functions include use as bird screens.

The types of structure with which the present invention is concerned comprise two main components: firstly a grating structure, and secondly tiles suspended from the grating structure. The grating structure is typically made of metal (e.g. steel) and typically comprises substantially parallel, generally regularly spaced, bars, which bars are vertical or substantially vertical when the grating structure is installed on a building.

Tiles, which are typically rectangular in shape and may be made from metal (e.g. steel) may be suspended from bars which are substantially horizontal when the structure is in situ. These bars are therefore typically perpendicular to the above-mentioned gratings bars and bridge across the grating's bars. The bars from which the tiles hang may provide a reinforcing effect to the grating, and optionally other struts or bars may also be present to provide a reinforcing effect to the grating. The metal tiles can swing, and the sequential swinging of tiles causes rippling, creating an aesthetic effect, for example when there are gusts of wind.

We have worked extensively with architectural structures of this type, and such structures have been installed on various buildings. We have now recognised certain problems which may occur with such structures, and the present invention relates to advantageous improvements of this technology.

From a first aspect the present invention provides an architectural structure comprising a grating panel, wherein said grating panel comprises securing means for securing said grating panel to a building or other structure, which when installed comprises substantially horizontal bars and tiles suspended from and pivotable on the axes of said horizontal bars, wherein said tiles cannot assume a position of stable equilibrium other than the position in which the tiles are suspended freely from said bars.

The present invention has the advantage that the aesthetic effect of suspended tiles can be maintained throughout the entire face of the structure. It is commonly desired to have tiles (for example rectangular tiles) arranged in a regular array such that all tiles are present and hanging correctly. We have found that the structure can be formed by using a plurality of grating panels, in many cases a large number of grating panels per installation. In other words, the grating structure attached to the outside of the building or other structure is formed from numerous separate grating panels, each of which in turn carries an array of suspended tiles. This facilitates installation, because the structure can be applied to the building in a modular manner, but it means that each module, or panel, needs to be secured. There may be numerous grating panels, e.g. at least 4, at least 10, at least 15, at least 20, at least 25, at least 30, at least 50, at least 75 or at least 100.

We have found that the means for securing each grating panel to the building (e.g. fixing plates) can interfere with the way in which the tiles rotate on the horizontal bars.

The structure is deliberately designed so that the tiles are articulated to the grating via the horizontal bars such that they hinge from said bars and can rotate around said bars. The result is that the tiles tend to move slightly under conditions of even mild wind or passing traffic thereby producing a rippling aesthetic effect.

However, occasionally tiles can pivot to a large extent, particularly under conditions of high wind, and sometimes tiles can rotate through more than 180°. This is not problematic for most tiles because in most cases the tiles can continue to rotate by a further 180° thereby reaching their original equilibrium hanging position after extensive rotation. However, for tiles in the vicinity of fixing plates or other securing means, large rotations of a tile can cause it to become stuck against said securing means.

We have recognised this problem and therefore recognise that a solution is to ensure that the tiles can not assume a position of stable equilibrium other than the position in which the tiles are suspended freely from said horizontal bars.

This results in a strong visual effect in which all tiles are in their correct positions. A large array of tiles on a grating structure formed from numerous grating panels is analogous to a screen having a large number of pixels. Just as it is desirable to avoid defective pixels on a screen, and for all pixels to be "live", so too is it desirable for all tiles in a large array to act in the same manner and for none to be "dead" or "stuck". This can also be important to ensure appropriate function throughout the whole structure.

The structure of the present invention may be cladding for a building or other construction.

Each tile can be part of a tile assembly, said tile assembly including the tile portion and a locating portion which secures the tile to the grating, e.g. via the horizontal bar.

The tile portion may be a substantially planar unit, or a unit which has a planar surface, and may typically have a regular geometric shape, e.g. a rectangular shape, e.g. a rectangular shape which is higher than it is wide, when installed. Other shapes are possible, for example a square shape. The tile portion may be a thin structure or a sheet, for example a metal sheet, for example a stainless steel sheet. Other possible materials from which the tiles may be made include aluminium or plastic.

In the tile assembly, the tile portion extends to a locating portion which secures the tile to the grating, for example by attaching to a horizontal bar, e.g. a cylindrical bar, of the grating (by "horizontal" is meant horizontal when the structure is installed, i.e. attached to a building). The locating portion may comprise a hook or barrel which, when the tile assembly is installed onto the grating, at least partially wraps around or surrounds the horizontal bar. Thus, the tile may swing back and forth due to being suspended from the bar like a pendulum, with the bar acting as a pin within the hook or barrel structure of the tile assembly, the latter rotatable relative to the former.

The tile portion and the locating portion of the tile assembly may be integrally formed. Conveniently, they may be formed from a single metal sheet, optionally a rectangular metal sheet, by folding one end of the metal sheet into a hook structure. Alternatively, rather than being folded or bent, the structure may be formed in other ways; for example structures may be formed or extruded. The skilled person is aware of suitable ways to provide shaped structures of steel, plastic, aluminium and other materials, including forming and extruding techniques. Said hook structure can hook over, and rest on, a horizontal bar, and hence can be suspended from said horizontal bar. The locating portion may be directly located on and in contact with the horizontal bar, or alternatively additional component(s) may be present, e.g. a sleeve around the horizontal bar, optionally wherein said sleeve is a plastic or polymer sleeve, and may optionally be cylindrical or part-cylindrical. Said hook structure may be closed, for example by a clip, so that there is at least one portion where the hook structure surrounds the pin of the horizontal bar and any optional sleeve, thereby ensuring that the hook structure cannot be dislodged from the bar (e.g. by over-rotation).

There are several ways of ensuring that the tiles cannot assume a position of stable equilibrium other than the position in which the tiles are suspended freely from said horizontal bars. One way, where a fixing plate (securing means) is attached on the rear side of the grating at a position where a tile would otherwise rest when over-rotated, is to modify the structure of the tile assembly so that a stop is provided on said tile assembly so that said stop abuts the securing means when only partial rotation of the tile has occurred, thereby preventing the tile from rotating to the extent of achieving a stable equilibrium in which the tile is not hanging. Said stop can take the form of a member projecting from the tile assembly. Said member can be a wing, and can optionally project from the barrel part of the tile assembly.

Another way of achieving the effect is to use securing means wherein the securing means is structured so that it contains a portion which abuts a tile (e.g. a face of the tile) before the tile is able to rotate to such an extent as to travel to or over the top of the axis of the horizontal bar and rest in an undesired position on said securing means. In some cases, this equates to ensuring that said tile can rotate by no more than 180°, e.g. by no more than 170°, e.g. by no more than 160°, e.g. by no more than 150°.

A yet further way of achieving the effect is to use an element, which may be neither part of or affixed to the tile assembly, nor part of or affixed to the securing means, to act as a stop after only partial rotation of the tile assembly, thereby avoiding the tile becoming "stuck" out of position, and causing the tile to fall back to its normal hanging position. Such element may be positioned on (e.g. welded on) the grating panel. It may for example project from (e.g. may extend substantially horizontally from) a vertical part of the grating panel. It may bridge between two adjacent vertical bars of the grating structure. It may take the form of a bar (e.g. a cylindrical bar or a bar of different shape, e.g. of rectangular or square cross section). It may be positioned above the bar from which the tile assembly hangs (so that it can prevent over-rotation of the tile), but not so far above as to impinge on the movement of the tile above.

It will be understood that the elements which act as stops to prevent excessive rotation need only be positioned in respect of tiles which would otherwise have the possibility of assuming a position other than the desired hanging position, for example in the vicinity of a securing means or fixing plate.

The ways of achieving the present invention are related and share the same inventive concept. In each case the arrangement is such that, if an extent of rotation of a tile relative to the bar it is suspended from would result in said tile becoming stuck against a component (e.g. securing means) of the grating, then the tile assembly and/or the securing means and/or other element are positioned or adapted so that rotation to such extent is prevented. The skilled person will understand that the way in which the tile will move will depend on its centre of gravity, and that the direction of the movement will determine whether the tile falls to a position in which it is hanging from the bar or resting in a different position.

It may be that the present invention is achieved by a combination of the above-mentioned features. For example, it may be that an adaptation to the tile assembly, in combination with the use of an element or feature on the grating panel and/or securing means, together provide the effect of preventing the tile from rotating to an undesirable equilibrium position.

The horizontal bars may suitably be cylindrical so that the tile assembly may rotate easily and may pivot easily on the axis of said bars. It may be that the tile assembly is directly or indirectly in contact with the bar; for example a plastic sleeve may be present on the bar, and may optionally remain stationary, or may not rotate to the same extent as the tile. Each tile assembly may comprise a substantially rectangular tile (e.g. a metal tile e.g. a stainless steel tile). Optionally this may be secured to and suspended from the metal bars by being wrapped around said metal bars. For example, each tile assembly may be prepared by preparing a rectangular sheet of steel or other suitable material, curling the end so that it can be hooked onto the horizontal bar, and then securing it so that said tile assembly cannot be dislodged from the bar by for example wind.

Thus the tile assembly may be considered to take the form of a leaf (e.g. a rectangular leaf) attached to an integral barrel wrapped around a pin (the horizontal bar).

The pin may be such that the barrel and/or other component(s) can be wrapped around it, in other words such that it can be completely encircled or surrounded (at least at one location) rather than being an edge of another entity. This allows a hook structure which is closed, for example by a clip, so that there is at least one portion where the hook structure surrounds the pin of the horizontal bar and any optional sleeve.

In some contexts in can be desirable, for aesthetic or other reasons, for the structure to allow considerable movement of the tiles, i.e. more than merely a slight pivot, so long as the objective of ensuring that the tiles return to their desired equilibrium position is maintained. Therefore, it may be that the tiles are able to rotate at least 10 degrees, or at least 20 degrees, or at least 30 degrees, or at least 40 degrees, or at least 50 degrees, or at least 60 degrees, or at least 70 degrees, or at least 80 degrees, or at least 90 degrees, or at least 100 degrees, or at least 110 degrees, or at least 120 degrees, forwards from their normal hanging position, and at least 10 degrees, or at least 20 degrees, or at least 30 degrees, or at least 40 degrees, or at least 50 degrees, or at least 60 degrees, or at least 70 degrees, or at least 80 degrees, or at least 90 degrees, or at least 100 degrees, or at least 110 degrees, or at least 120 degrees, backwards from their normal hanging position, For example, it may be that the tiles are able to rotate at least 90 degrees forwards from their normal hanging position, and at least 90 degrees backwards from their normal hanging position. For example, it may be that the tiles are able to rotate at least 45 degrees forwards from their normal hanging position, and at least 45 degrees backwards from their normal hanging position.

The present invention will now be described in further, non-limiting detail, with reference to the following figures in which.

Figure 1:
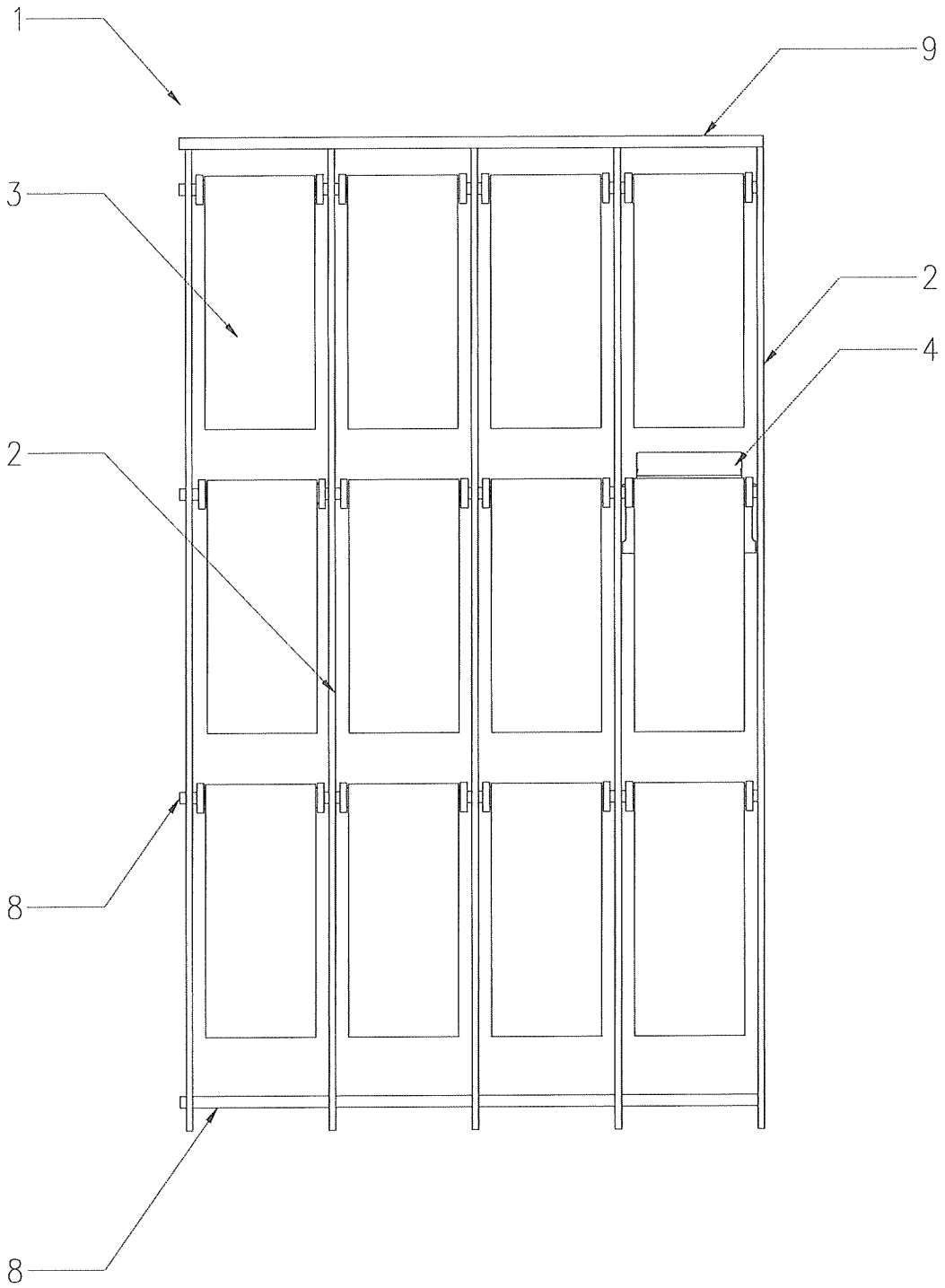
FIGS. 1 to 4 show a schematic representation of a grating panel in accordance with one embodiment of the present invention, from the front, in rear perspective view with all tiles hanging downwards, in rear perspective view with one tile shown at maximum rotation, and in cross-section from the side with one tile shown at maximum rotation, respectively.

FIGS. 13 to 16 show a schematic representation of a grating panel in accordance with a yet further embodiment of the present invention, from the front, in rear perspective view with all tiles hanging downwards, in rear perspective view with one tile shown at maximum rotation, and in cross-section from the side with one tile shown at maximum rotation, respectively; and FIGS. 17 to 20 show a schematic representation of a grating panel in accordance with a yet further embodiment of the present invention, from the front, in rear perspective view with all tiles hanging downwards, in rear perspective view with one tile shown at maximum rotation, and in cross-section from the side with one tile shown at maximum rotation, respectively;

With reference to FIG. 1, panel 1 carries twelve tiles 3 in a 4×3 array. The grating panel contains vertical parallel grating bars 2 and in this particular embodiment a horizontal framing bar 9 is also present. The tiles 3 are suspended from i.e. hang freely from cylindrical bars 8. Three of the bars 8 are obscured in FIG. 1 by the tile assemblies but one bar 8 is shown at the bottom of the grating panel which may continue downwards.

Figure 2:
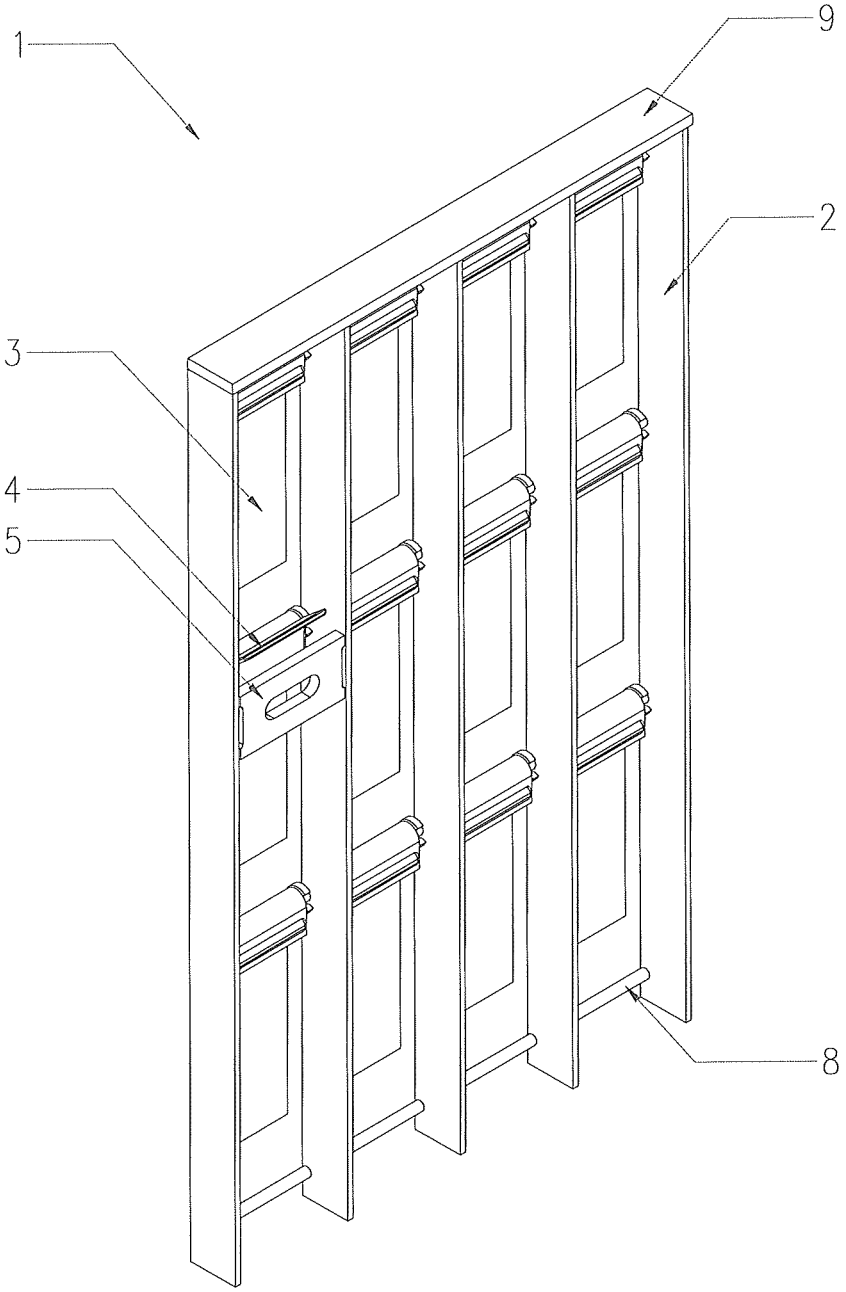
Figure 3:
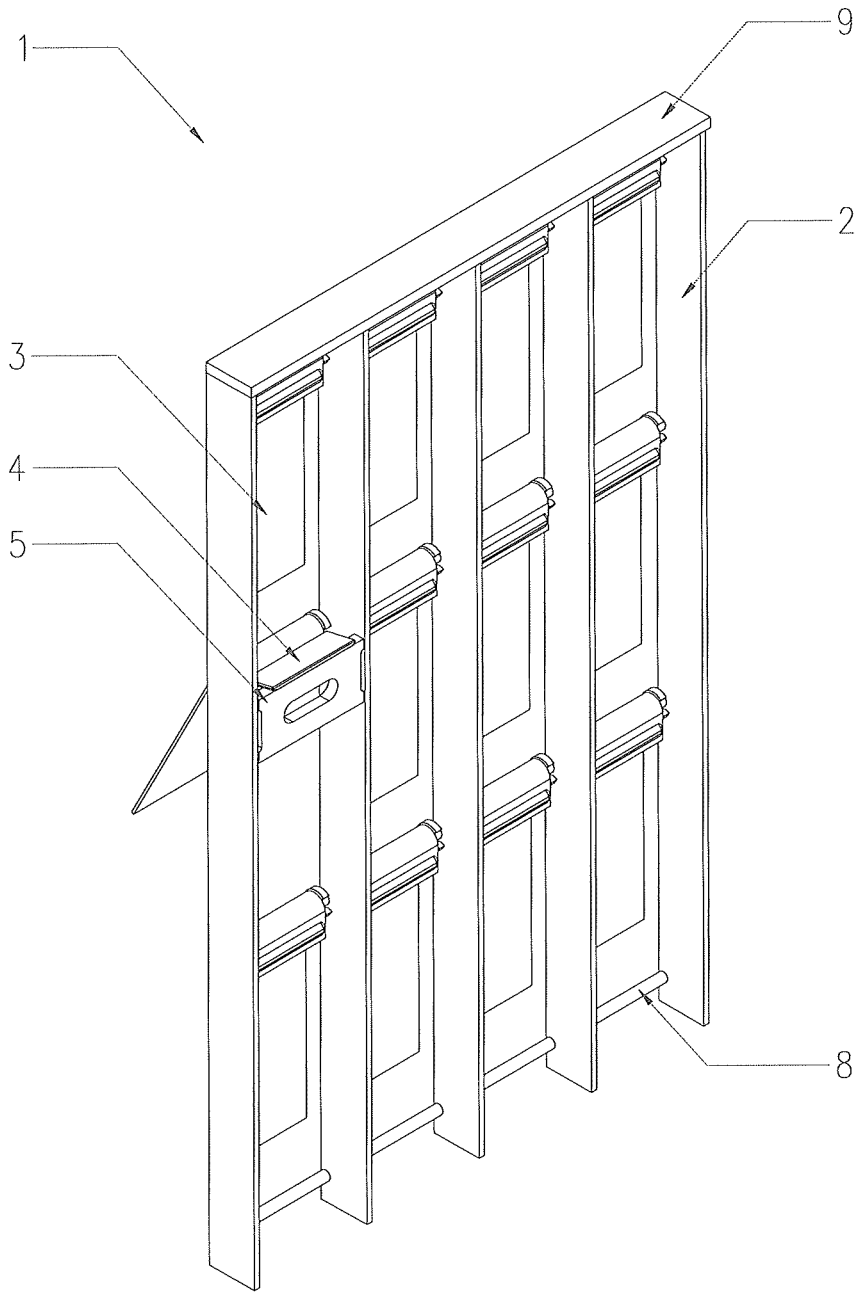

As shown most clearly in FIGS. 2 and 3 the grating panel comprises securing means in the form of a fixing plate 5. Only one fixing plate 5 is shown and it will be appreciated that other fixing plates could be present and other means be provided to secure the grating panels to a building and to each other.

Figure 5:
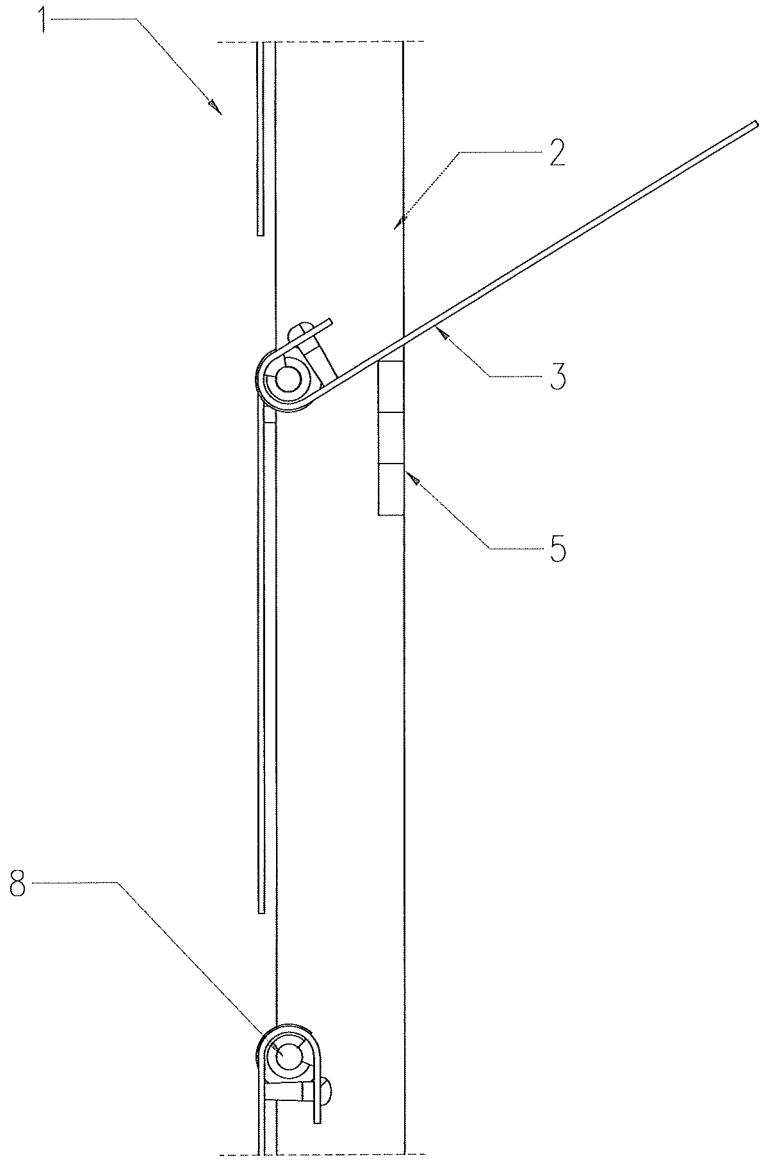
FIG. 5 shows a schematic representation of a tile in an undesired position, which can arise in the absence of the improvement of the present invention.

A problem which can be caused by the presence of fixing plate 5 can be seen in FIG. 5 which shows that after over-rotation of a tile 3, the tile 3 can rest and become stuck out of its normal position by resting against fixing plate 5.

Figure 4:
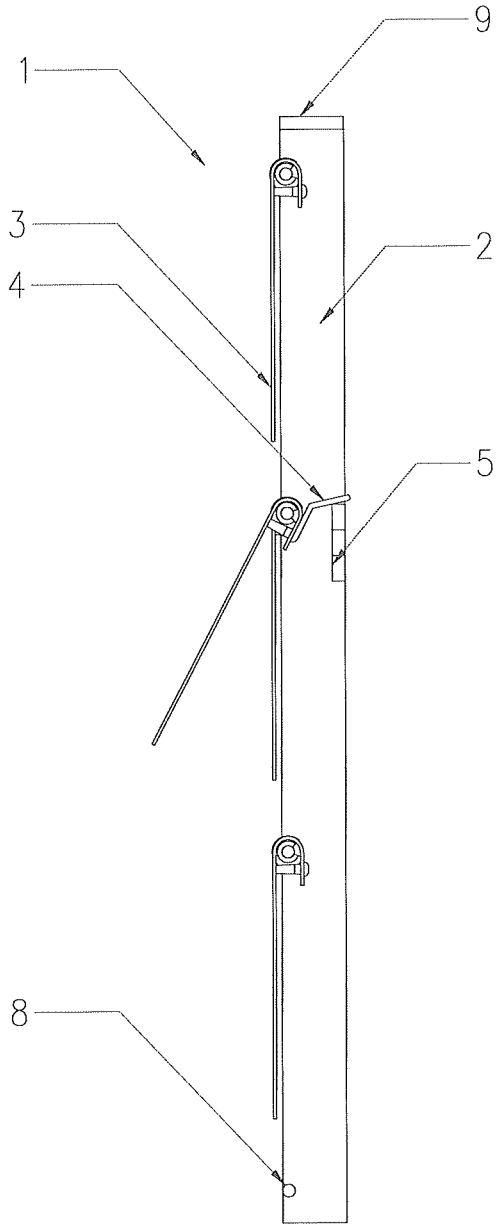

To solve this problem, wing clip 4 is attached to an appropriate tile 3 and acts as a stop. It prevents the tile from travelling too far from its equilibrium, hanging, substantially vertical position. (The hanging position is "substantially vertical" rather than precisely vertical: the plane of the tile is slightly tilted due to the tile extending from one side of the tile assembly.) The maximum extent of travel possible when the wing clip is present is shown in FIG. 4; rotation can only occur to a relatively small extent, after which the tile returns to its normal equilibrium position. There is thus no possibility for the tile to assume an equilibrium position other than the one in which it hangs freely.

Figure 6:
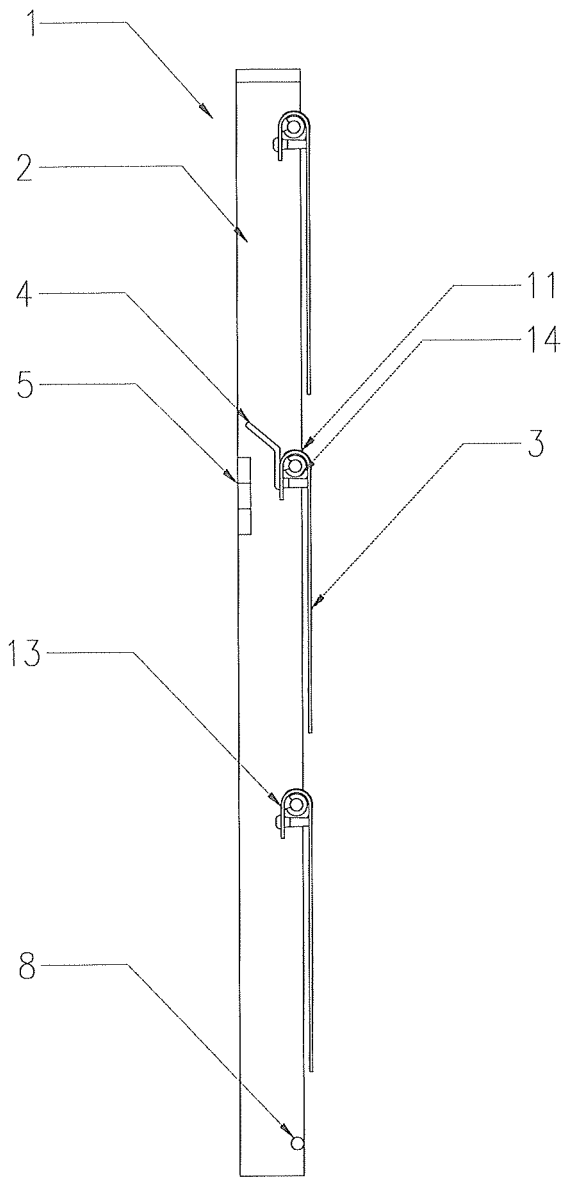
FIGS. 6 and 7 show a schematic representation of a tile assembly of the present invention in further detail.
Figure 7:
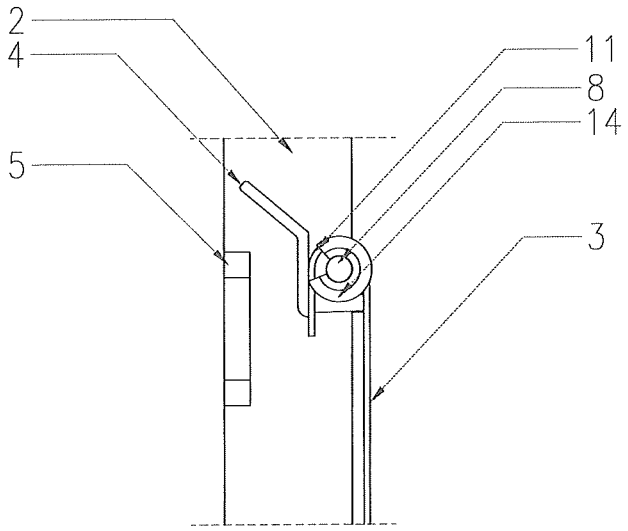
Figure 8:
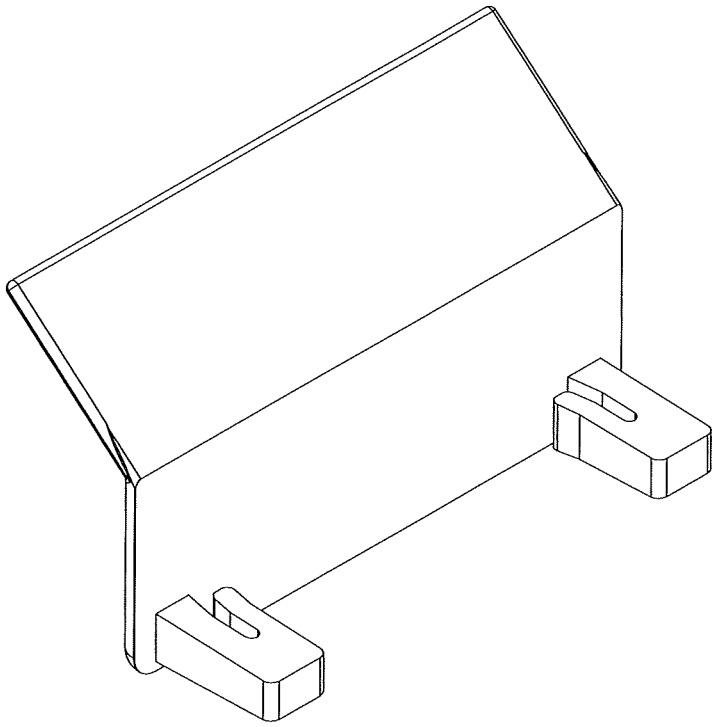
FIG. 8 shows a clip which may act as a stop to prevent over-rotation of a tile assembly.
Figure 9:
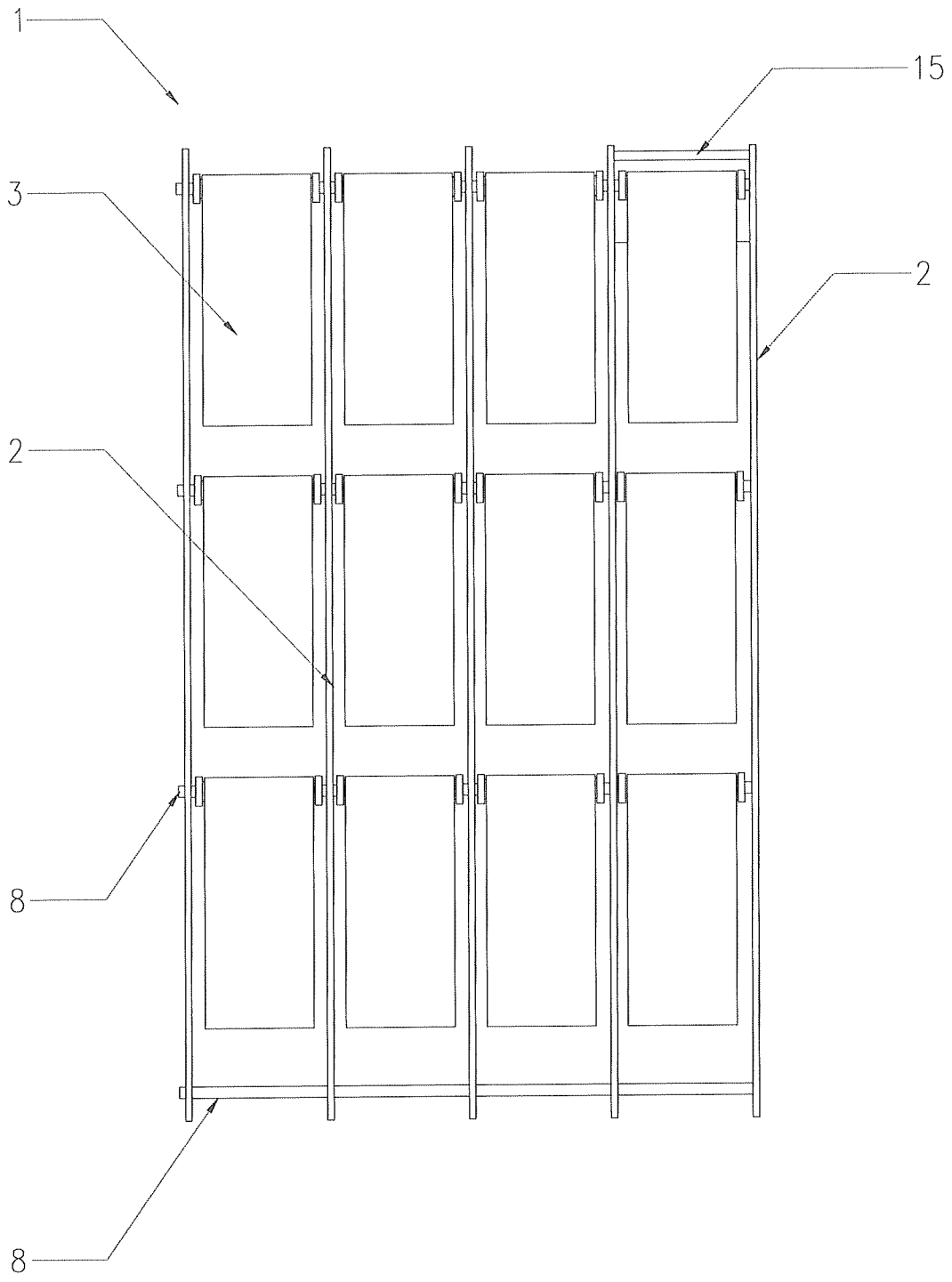
FIGS. 9 to 12 show a schematic representation of a grating panel in accordance with a further embodiment of the present invention, from the front, in rear perspective view with all tiles hanging downwards, in rear perspective view with one tile shown at maximum rotation, and in cross-section from the side with one tile shown at maximum rotation, respectively.
Figure 10:
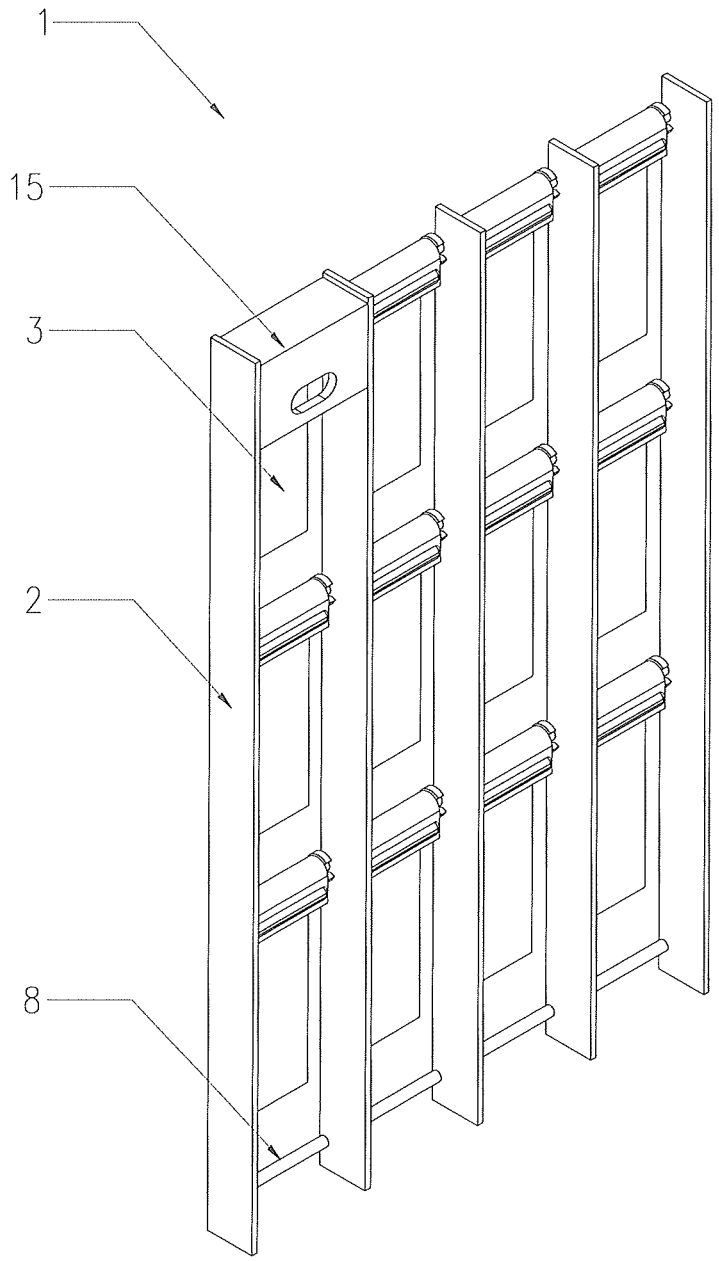
Figure 11:
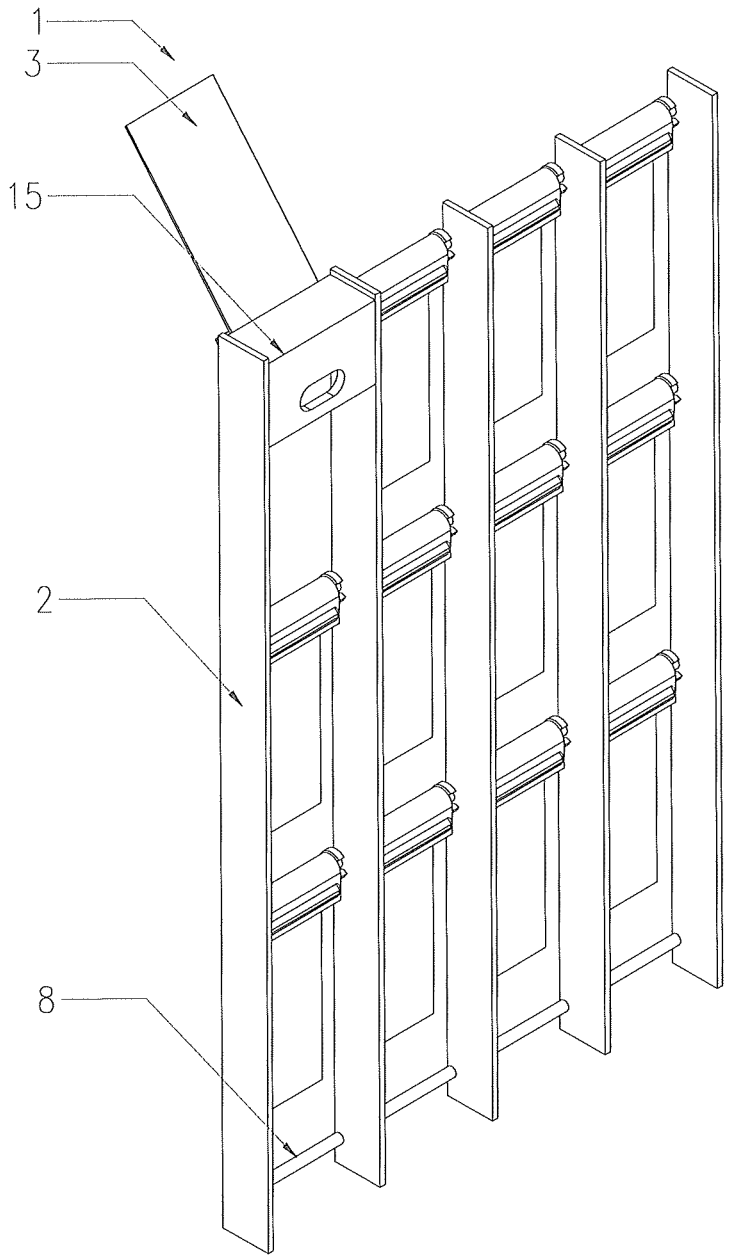

The structure of the tile assemblies can be seen in more detail in FIG. 6. The tile contains a large planar portion 3 extending to a curved portion 11 at its top which is hooked over rod 8. The tile may be formed from a sheet (for example of stainless steel) and may be bent around at the top to form a rear part 13 of a hook which is substantially parallel to the main planar surface of the tile 3. A clip 14 may be used to connect the rear portion 13 and the main portion of the tile 3 thereby constraining the tile assembly on rod 8. As noted above, some tiles may contain wing clips 4 to act as stops against parts of the structure 5 which could otherwise act as means for trapping the tiles after over rotation. An expanded figure of the tile assembly's locating portion, containing a clip assembly, is shown in FIG. 7, and an example of a suitable clip is shown in FIG. 8.

Figure 12:
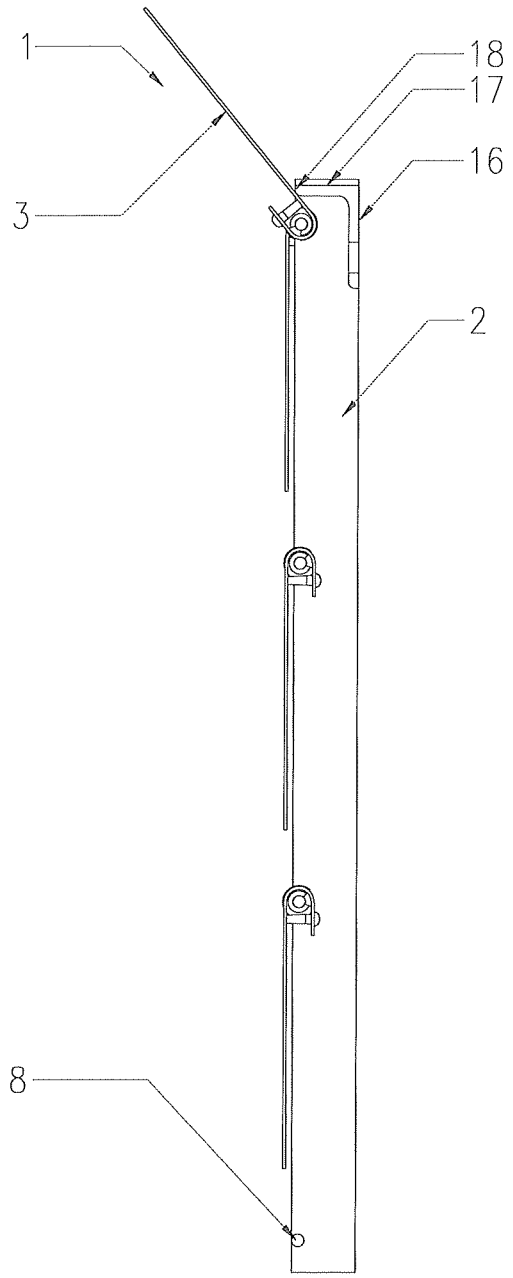
Figure 13:
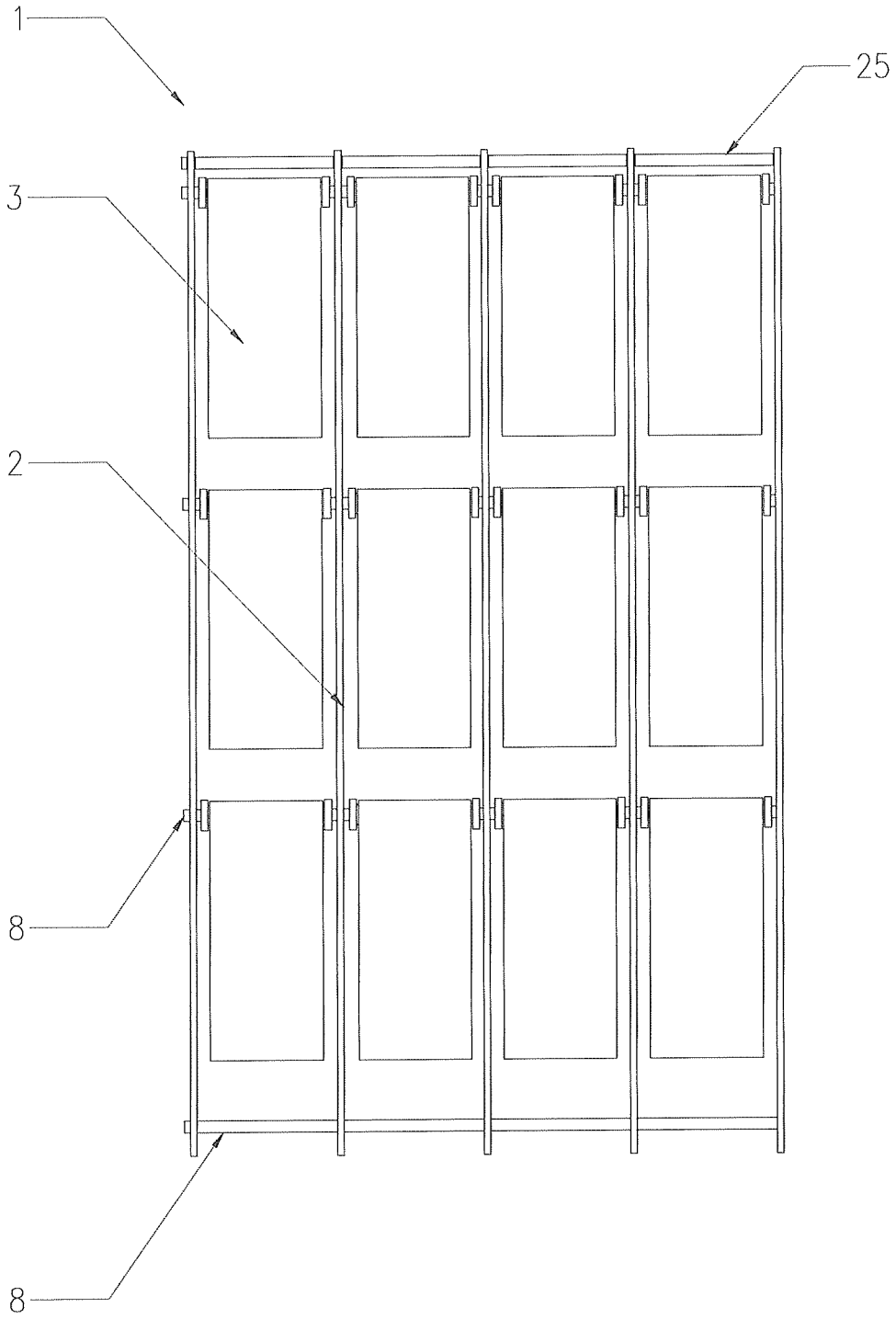
Figure 14:
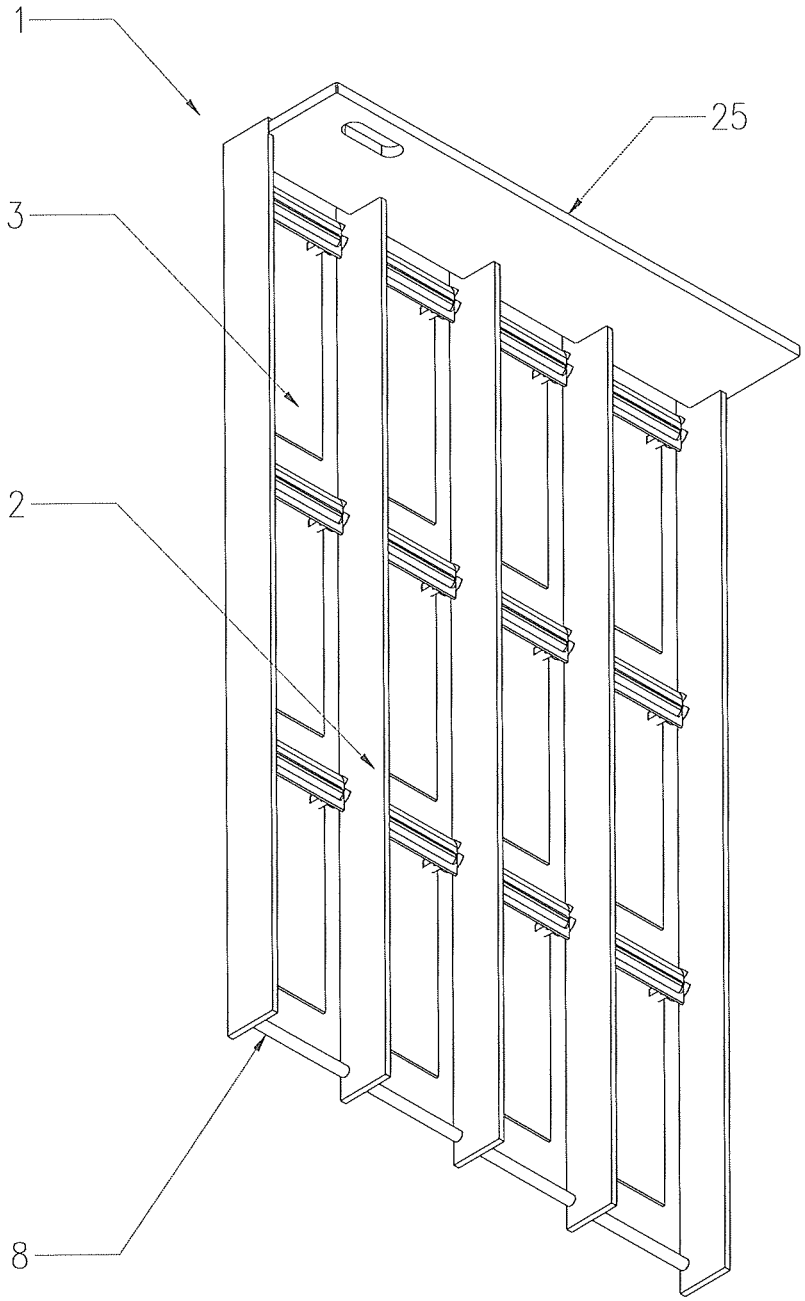
Figure 15:
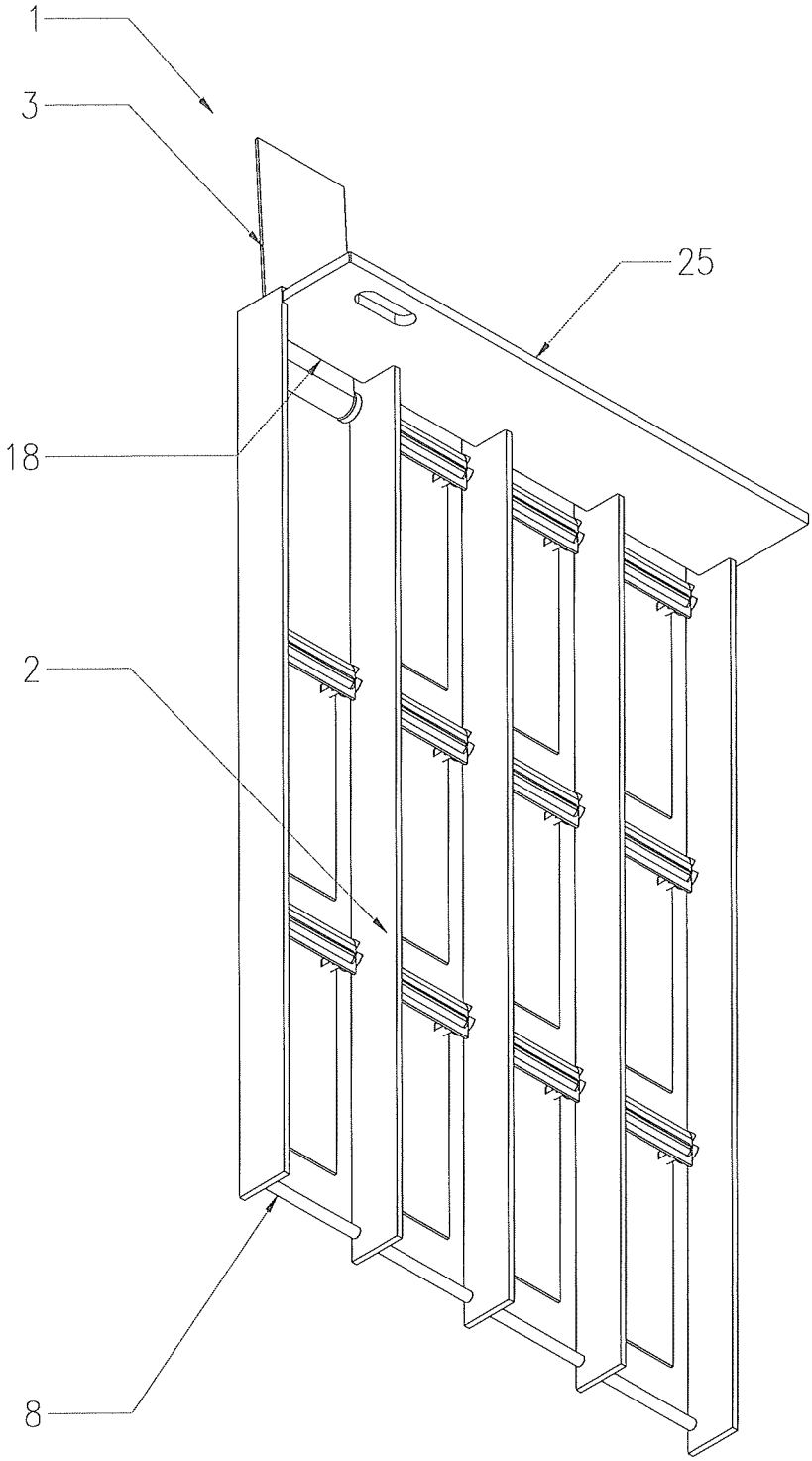
Figure 16:
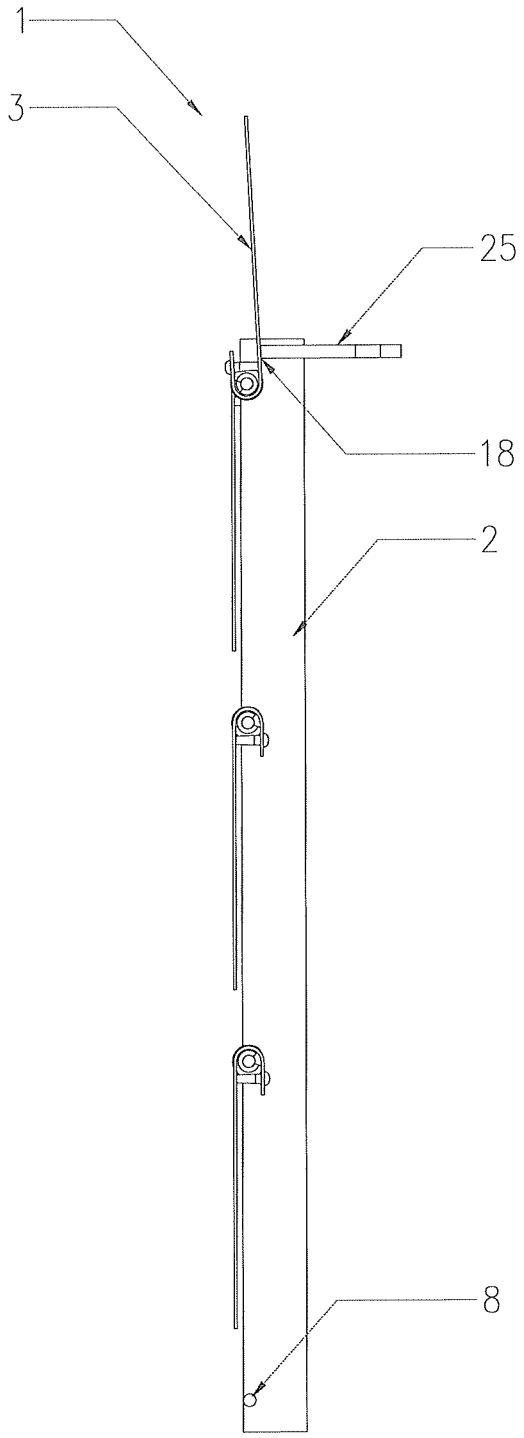
Figure 17:
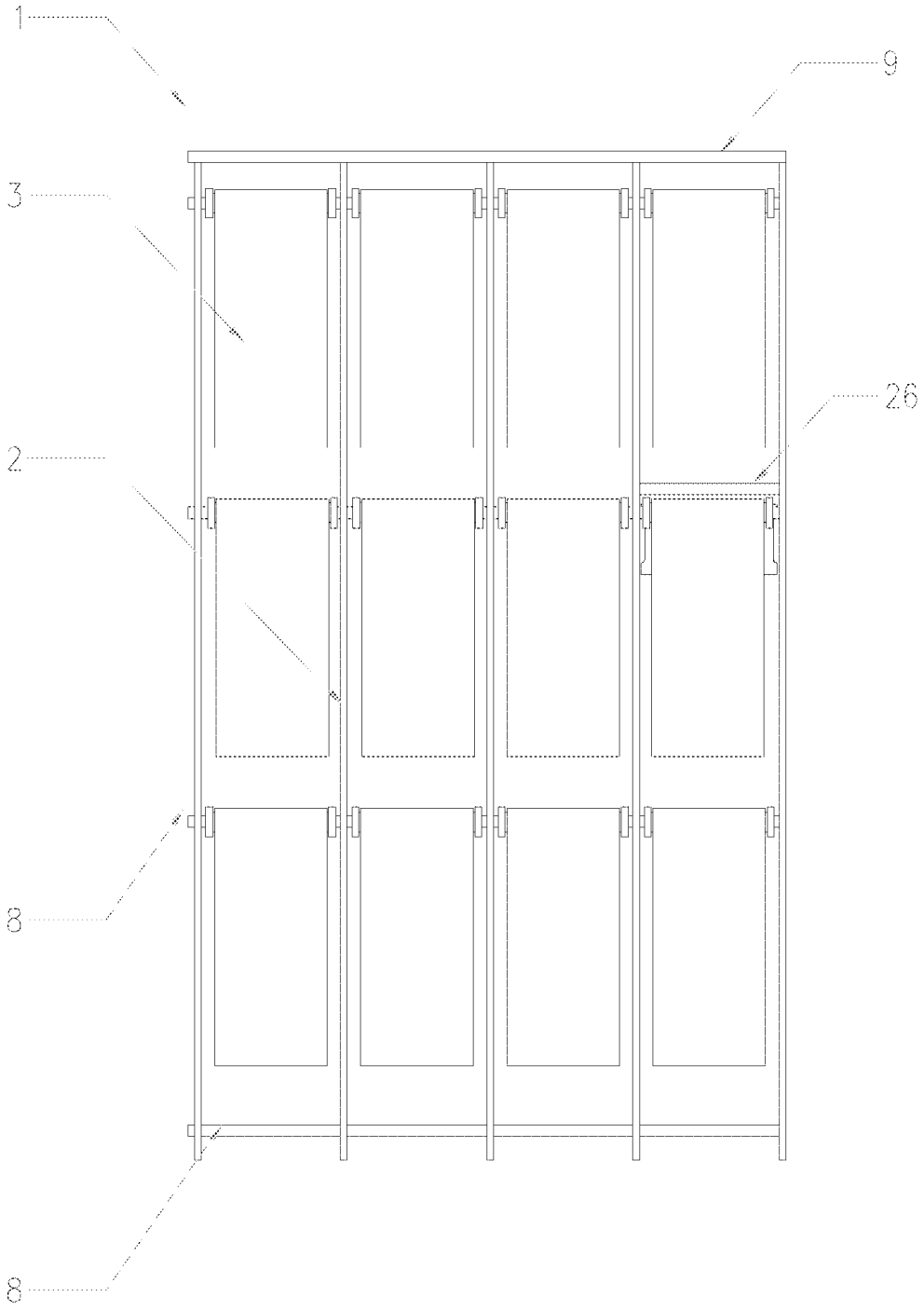
Figure 18:
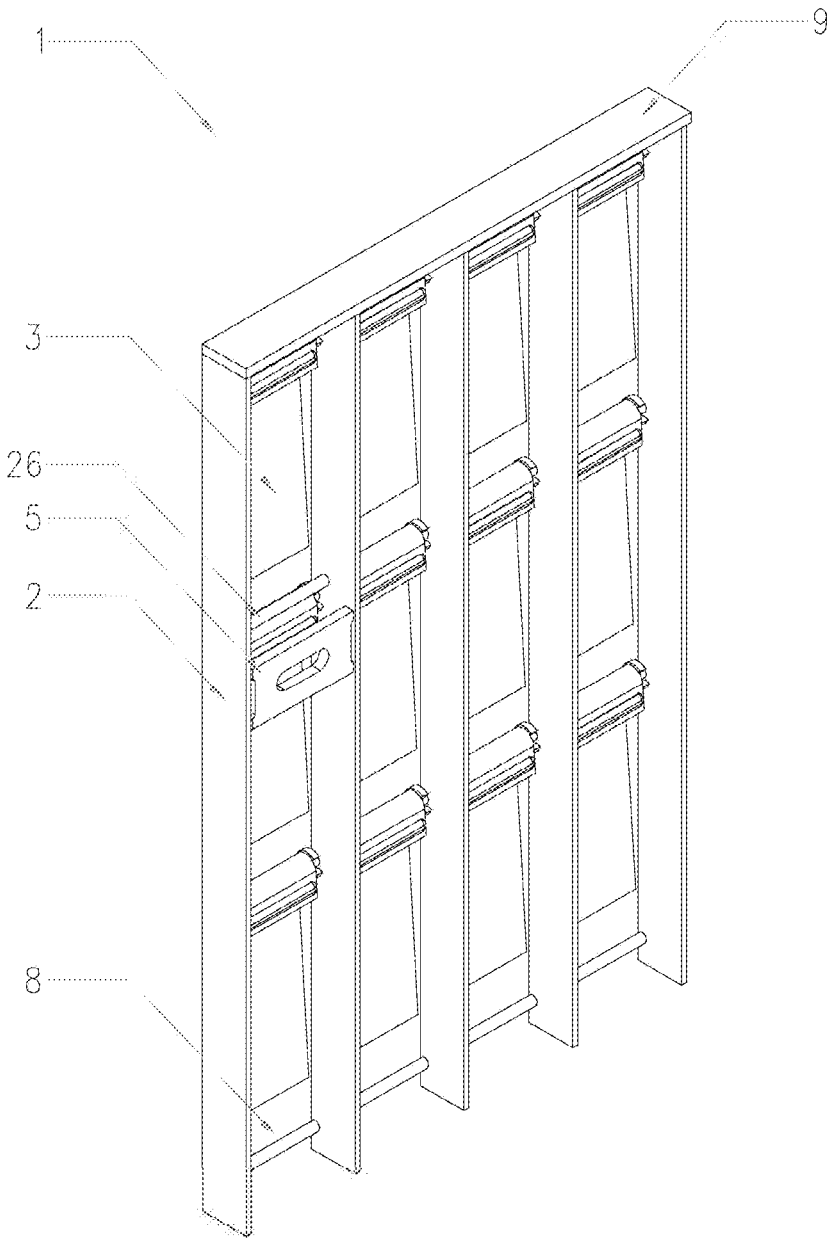
Figure 19:
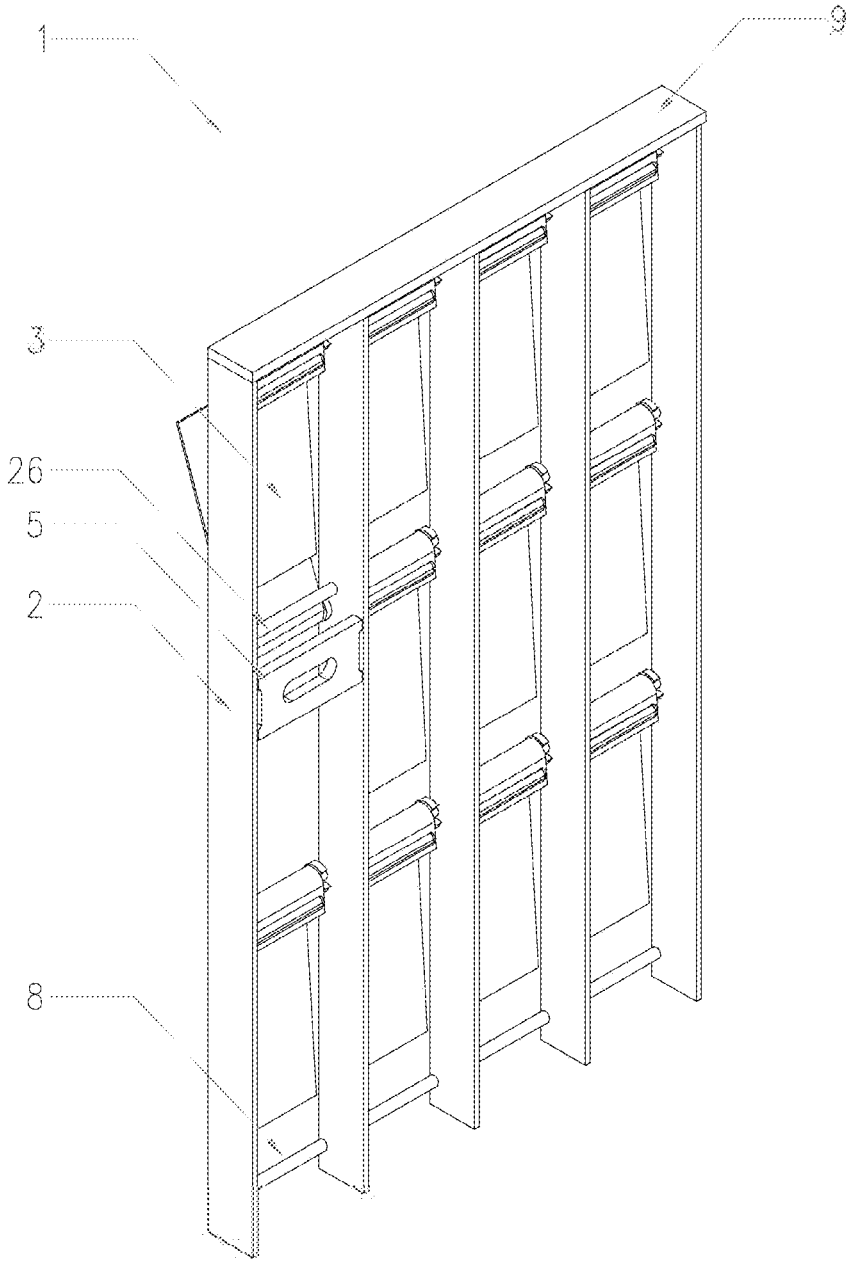
Figure 20:
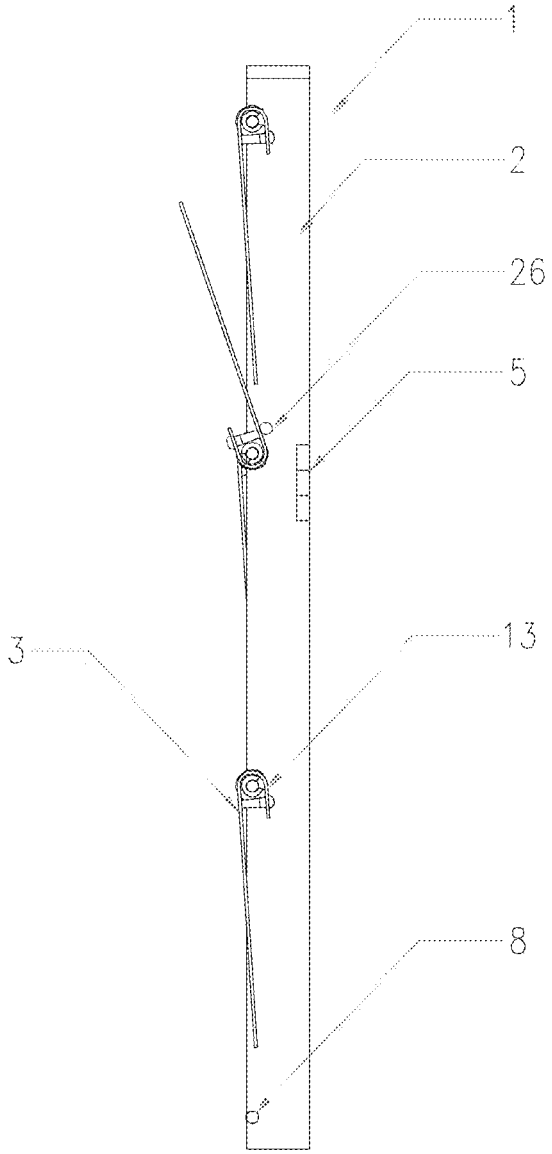

A second embodiment is shown in FIGS. 9 to 12. In this embodiment, a different type of fixing plate 15 is used. Fixing plate 15 comprises a substantially vertical portion 16 affixed, in a substantially L-shaped configuration, to a substantially horizontal portion 17. The end 18 of the horizontal portion acts as a stop thereby limiting the extent to which the tile assembly can rotate around rod 8. As shown in FIG. 12, this prevents the tile from reaching the approximately 180° vertical position and accordingly the tile cannot over-rotate beyond the position from which it will return. The tile is therefore not able to get stuck out of position and will always fall back to the hanging position.

A third embodiment is shown in FIGS. 13 to 16. In this embodiment a different securing means 25 is used, which not only enables fixing of the unit but is also able to act as an upper frame member and has a comb configuration with respect to vertical gratings bars to which it can be secured. As with the second embodiment, the securing member 25 extends horizontally and has an end 18 positioned and located such that it can act as a stop to prevent over rotation of the tile assembly.

A fourth embodiment is shown in FIGS. 17 to 20. In this embodiment, an element 26 acts as a stop to prevent over-rotation of the tile assembly. Element 26 is neither part of the tile assembly, nor part of the securing means/fixing plate, but is present on the grating panel. In the embodiment illustrated, element 26 is a horizontal bar 26 positioned slightly above the bar 8 around which the tile assembly pivots, but not so far above as to hinder the rotation of the next tile assembly above. In the embodiment illustrated, horizontal bar 26 is positioned slightly back from the bar 8 so that it abuts the tile after a large extent or rotation but not so much as to allow the tile to assume a stable position resting against bar 26.

The invention claimed is:

1. An architectural structure comprising a grating panel, wherein said grating panel comprises securing means for securing said grating panel to a building, the grating panel comprising substantially horizontal bars and tiles suspended from and pivotable on axes of said horizontal bars, wherein said tiles cannot assume a position of stable equilibrium other than the position in which the tiles are suspended freely from said horizontal bars wherein the securing means contains a portion configured to abut a tile before the tile is able to rotate to such an extent as to rest on said securing means.

2. The architectural structure of claim 1, comprising at least 20 of said grating panels.

3. The architectural structure of claim 1, wherein the architectural structure is cladding for a building.

4. The architectural structure of claim 1, wherein said tiles are part of tile assemblies, and wherein said tile assemblies comprise tile portions and locating portions which secure the tiles to the gratings.

5. The architectural structure of claim 4, wherein the locating portions comprise hooks or barrels which at least partially surround the horizontal bars, and which are rotatable around the horizontal bars.

6. The architectural structure of claim 4, wherein tile portions and locating portions are integrally formed.

7. The architectural structure of claim 4, wherein tile assemblies are shaped by one or more of forming, folding and/or extruding.

8. The architectural structure of claim 5, comprising sleeves intermediate the horizontal bars and the hooks or barrels.

9. The architectural structure of claim 4, wherein a stop is provided on a tile assembly so that said stop abuts a securing means when only partial rotation of the tile has occurred, thereby preventing the tile from rotating to the extent of achieving a stable equilibrium in which the tile rests against the securing means.

10. The architectural structure of claim 9, wherein said stop is a member projecting from the tile assembly.

11. The architectural structure of claim 1, wherein said portion prevents said tile from rotating more than 180 degrees from its equilibrium hanging position.

12. The architectural structure of claim 1, comprising substantially planar, rectangular tiles.

13. The architectural structure of claim 1, comprising metal or plastic tiles.

14. The architectural structure of claim 13, wherein the metal is steel.

15. A building comprising the architectural structure of claim 1.

16. The architectural structure of claim 1, wherein the portion is configured to abut a face of the tile before the tile is able to rotate to such an extent as to rest on said securing means.

17. The architectural structure of claim 1, wherein the securing means comprises a fixing plate.

18. The architectural structure of claim 17, wherein the portion is configured to abut a face of the tile before the tile is able to rotate to such an extent as to rest on said fixing plate.

* * * * *